United States Patent [19]

Phillips

[11] Patent Number: 4,780,058

[45] Date of Patent: Oct. 25, 1988

[54] STABLE FLUID FOIL SECTION

[75] Inventor: Adrian Phillips, Victoria, Canada

[73] Assignee: Marine Systems Research Inc., Toronto, Canada

[21] Appl. No.: 937,244

[22] Filed: Dec. 3, 1986

[51] Int. Cl.[4] ..... B63H 1/26

[52] U.S. Cl. ..... 416/242; 416/223 R

[58] Field of Search ..... 416/223 R, 243, 242, 416/DIG. 2

[56] References Cited

U.S. PATENT DOCUMENTS

| | | | |
|---|---|---|---|
| 4,073,601 | 2/1978 | Kress | 416/223 R |
| 4,413,796 | 11/1983 | Bousquet | 416/242 |
| 4,608,823 | 9/1986 | Maze | 416/223 A |

*Primary Examiner*—Larry I. Schwartz

*Attorney, Agent, or Firm*—Arne I. Fors; Robert F. Delbridge

[57] ABSTRACT

A fluid foil for use in a marine propeller having an upper surface with a uniform, continuous convex shape commencing at the leading edge and terminating at the trailing edge of the foil section and a lower foil face having a convex shape extending from the said leading edge to the foil mid/chord position and having a concave shape extending from the said mid-chord position to the said trailing edge. An effective pitch line extending from the foil leading edge to the foil trailing edge is intersected tangentially by the concave shape of the lower foil face.

2 Claims, 2 Drawing Sheets

STABLE FLUID FOIL SECTION

BACKGROUND OF THE INVENTION

This invention relates to a fluid foil section having improved lift characteristics and, more particularly, relates to a novel fluid foil section having a "nose-down" or stable pitching moment for particular utility in marine propellors.

The thrust produced by a propellor blade configuration having a typical convex forward surface and flat rear surface is comprised of approximately $\frac{2}{3}$ thrust due to drop in pressure i.e. suction, over the upper convex forward surface of the blade, primarily near the leading edge, and approximately $\frac{1}{3}$ thrust due to a rise in pressure on the flat under rear surface or face of the blade. This distribution of thrust is of little consequence with rigid foils made of aluminum, bronze or steel but, when applied to less rigid foils made of plastics which may flex, can lead to serious problems arising from induced increase in the pitch angle. These problems include an undesirable increase in blade loading, induced drag, reduced revolutions per minute (RPM) and potential blade stall.

A further problem usually inherent with conventional blade configurations is that it is necessary to avoid peak negative pressures on the blade's upper surface which, if allowed to drop below 4 pounds per square inch absolute, causes water vapour to form resulting in cavitation and loss of thrust, coupled with blade damage. To avoid this possibility, the curvature of the convex upper surface of the blade often is reduced. As the amount of curvature corresponds to the amount of lift/unit area, more blade area must be utilized to produce the desired propulsion force. More blade area increases the wetted surface of the blades, and hence the drag, which is a function of the relative water velocity cubed.

Initial attempts to reduce the reliance of the majority of propellor thrust being created by negative pressure appear in U.S. Pat. No. 3,635,590 granted Jan. 18, 1972. While this configuration appears to transfer a good proportion of the lift to a positive pressure on the face of the blade, the following undesirable features precluded this design from competitive utility. The upper, or forward surface, in common with the lower surface, were essentially planar with a convex surface near the leading edge. Since such surfaces produce a minimum of lift, their incorporation into blade designs was limited in utility. A nose-up pitching moment remained, permitting unproductive blade flexing of plastic blades to occur.

U.S. Pat. No. 3,697,193 granted Oct. 10, 1972 discloses a propellor blade configuration in which an attempt was made to increase the distribution of pressure to a more positive value on the face of the blade. The modified blade not only increased the pressure loading on the face of the blade, it moved the pressure loading towards the trailing edge. However, the following problems remained. The upper and lower surfaces were still essentially planar. Subsequent analysis and tests of the fluid foil section revealed that there was a positive pressure produced on the face of the blade immediately adjacent to the leading edge, which would preclude a desired nose-down pitching moment of the blade foil.

BRIEF STATEMENT OF INVENTION

I have found that a fluid foil which provides a nose-down pitching moment, i.e. a stable foil, to a propellor blade when under load, would result in flexing of the blades into a reduced pitch angle, thus allowing for greater revolutions per minute and increased resultant power. In addition, a foil with minimum disc area ratio, i.e. a propellor blade with a minimum of blade area with respect to a disc of equal diameter, would present less wetted surface and hence less frictional drag. In its broad aspect, the fluid foil of the present invention, particularly for use in a marine propellor, comprises a fluid foil section having a leading edge and a trailing edge and an upper surface and a face, said upper surface of said fluid foil section having a uniform, continuous convex shape commencing at the leading edge and terminating at the trailing edge, said fluid foil face having a convex shape extending from the leading edge to the mid-chord position of the said fluid foil, said fluid foil having a concave shape from the mid-chord position to the trailing edge of the fluid foil.

BRIEF DESCRIPTION OF THE DRAWINGS

The fluid foil of the invention will now be described with reference to the accompanying drawings, in which.

DESCRIPTION OF THE PREFERRED EMBODIMENTS

Figure 1:
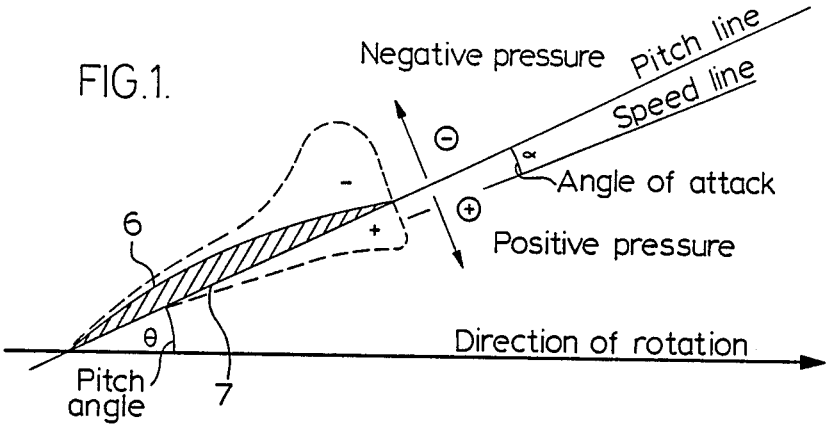
FIG. 1 is a transverse section of a conventional fluid foil shape having a convex forward shape and flat rerr surface or face.
Figure 2:
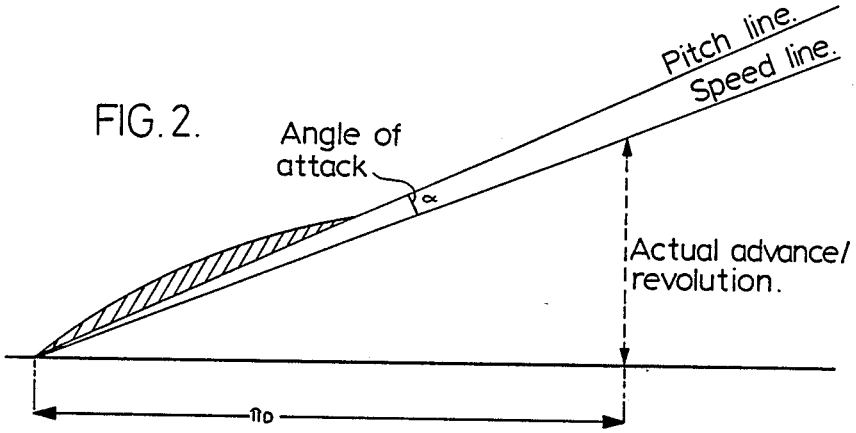
FIG. 2 is a sectional view of the fluid foil shown in FIG. 1 incorporated in a traditional propellor blade showing the rear surface lying along a pitch line.
Figure 3:
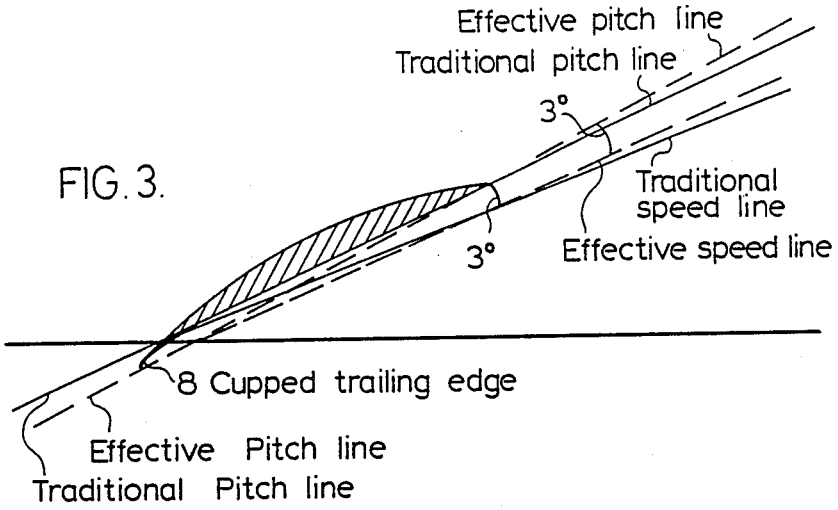
FIG. 3 is a sectional view of the fluid foil shown in FIG. 1 illustrating the effective pitch of the fluid foil represented by a line passing through the leading edge and a cupped trailing edge.

FIGS. 1, 2 and 3 illustrate conventional fluid foil shapes wherein the upper or forward surface 6 has a convex shape and the rear or lower surface 7 is flat. The pitch of the fluid foil is defined as the theoretical advance of a propellor blade tip embodying the shape in one complete revolution. The pitch angle may be described as the tangent of the pitch over the circumference of the circle described by the blade tips of a propellor having a plurality of blades in one revolution. The pitch line is described as the line passing through the propellor circumference line at a pitch angle $\theta$.

With particular reference to FIG. 1, the relationship between the pitch line, the speed line and the propellor blade's angle of attack with specific reference to a marine propellor is illustrated. A rotating blade passes through the water with an angle of attack in order to produce lift, or thrust, by virtue of its angle to the relative velocity of the water with respect to the blade. It is well established that the optimum lift to drag ratio occurs when the angle of attack is approximately 3 degrees. This denotes the actual advance of the propellor tips per revolution, being the same as the boat speed, and these 3 degrees should be deducted from the pitch angle to indicate the speed line. It has been found that for any propellor and pitch, at any selected propellor RPM, the boat speed cannot rise above this line.

The thrust produced by such a propellor blade configuration is made up of approximately $\frac{2}{3}$ thrust due to a drop in pressure (suction) over the upper surface of the blade, primarily near the leading edge, and $\frac{1}{3}$ thrust due to a rise in pressure on the under surface, or face of the blade. This distribution of thrust components is of little consequence with regard to rigid foils made of aluminum, bronze or steel, as has been discussed, but when applied to a plastics material which does not have the same degree of rigidity, flexing may occur which can lead to serious problems arising from the induced increase in pitch angle. For example, an undesirable increase in blade loading, induced drag, reduced RPM and even blade stall may occur.

Figure 4:
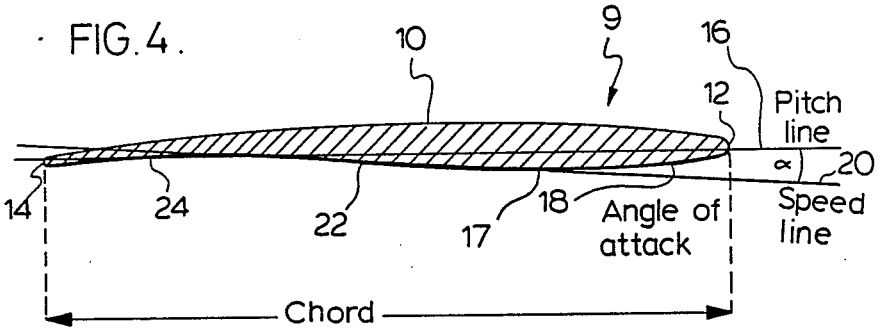
FIG. 4 is a sectional view of the fluid foil of the present invention.
Figure 5:
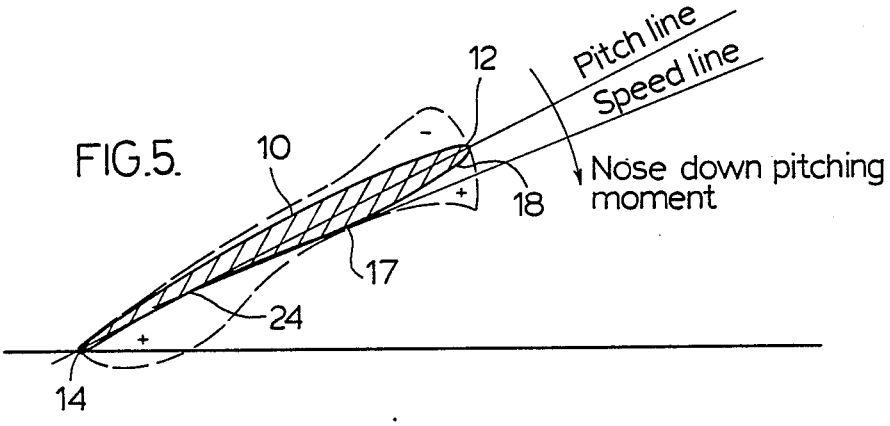
FIG. 5 is a sectional view of the fluid foil shown in FIG. 4 with graphical illustration of pressure distribution about the fluid foil.

With reference now to FIG. 2 and 3, an example of theoretical pitch, as opposed to effective pitch, is illustrated. A traditional propellor blade section, as illustrated specifically in FIG. 2, shows the face of the blade lying along the pitch line. This is traditionally correct as a designation of pitch but, in majority of propellor blades currently used in the outboard and inboard/outboard motor market, propellor blades are "cupped". The trailing edges 8 of the blades are curved sharply downwards, as shown most clearly in FIG. 3. However, in this effort to increase propellor performance, the effective pitch of the propellor was increased to raise the speed line accordingly, thereby producing more speed (assuming power is available) at any give selected RPM. With reference now to FIGS. 4 and 5, the fluid foil 9 of the present invention has a uniform, convex shape 10 extending from the leading edge 12 to the trailing edge 14 of the foil. The effective pitch line 16 passes through the mid point of both the leading edge 12 and the trailing edge 14, as illustrated.

The forward portion of the blade face 17 has a convex shape 18. This uniform, convex shape commences at the leading edge 12 and intersects the speed line 20 tangentially at the mid-chord position 22. The surface 17 of the blade face then proceeds towards the trailing edge 14 through concave arc 24, arc 24 commencing at the mid-chord position 22 tangentially to speed line 20 and terminating at trailing edge 44. These two curves, 18 and 24, meet tangentially at mid-chord position 22 on speed line 20. Curve 24 intersects pitch line 16 tangentially a position about 65% of the chord length from leading edge 12.

The pressure distribution of the fluid foil of the present invention passing through a fluid at an angle of attack of about 3 degrees is generally illustrated in FIG. 5. It will be noted that the majority of lift (thrust) is produced on the face 17 of the foil at the concave portion 24 towards the trailing edge 14. This positive thrust in proximity to the trailing edge results in a desired nose-down (stable) pitching moment. This stable pitching moment permits the important advantage of reduction of the blade area with resulting less wetted surface and less frictional drag.

It will be understood, of course, that modifications can be made in the embodiment of the invention illustrated and described herein without departing from the scope and purview of the invention as defined by the appended claims

I claim:

1. A fluid foil for use in a marine propeller comprising a fluid foil section having a leading edge and a trailing edge with an effective pitch line passing through the leading edge and the trailing edge, and an upper surface and a face, said upper surface of said fluid foil section having a uniform, continuous convex shape commencing at the leading edge and terminating at the trailing edge, said fluid foil face having a convex shape extending from the leading edge to the mid-chord position of the said fluid foil and having a concave shape from the mid-chord position to the trailing edge of the said fluid foil, said concave shape intersecting the pitch line tangentially.

2. A fluid foil as claimed in claim 1 in which the concave shape intersects the pitch line tangentially at a position about 65% of the chord length from the leading edge.

* * * * *